US006745692B2

(12) United States Patent
Lorig et al.

(10) Patent No.: US 6,745,692 B2
(45) Date of Patent: Jun. 8, 2004

(54) SLEEVE FOR FLEXOGRAPHIC PRINTING

(75) Inventors: Heinz Lorig, Legden (DE); Stephan Lorig, Legden (DE)

(73) Assignee: Polywest Kunststofftechnik Saueressig & Partner GmbH & Co. KG (DE)

( * ) Notice: Subject to any disclaimer, the term of this patent is extended or adjusted under 35 U.S.C. 154(b) by 0 days.

(21) Appl. No.: 10/277,661

(22) Filed: Oct. 22, 2002

(65) Prior Publication Data

US 2003/0177925 A1 Sep. 25, 2003

(30) Foreign Application Priority Data

Mar. 19, 2002 (DE) ..... 202 04 412 U

(51) Int. Cl.[7] ..... B41F 5/00; B41F 13/10; B41L 47/14

(52) U.S. Cl. ..... 101/375; 101/376; 101/216; 101/479; 101/217; 101/219; 101/389.1; 101/142; 101/148; 101/477

(58) Field of Search ..... 101/375, 376, 101/479, 216, 217, 219, 389.1, 142, 148, 477

(56) References Cited

U.S. PATENT DOCUMENTS

| | | | | |
|---|---|---|---|---|
| 4,599,943 A | * | 7/1986 | Kobler | 101/217 |
| 4,864,926 A | | 9/1989 | Saueressig | |
| 5,507,228 A | * | 4/1996 | Schulz | 101/375 |
| 5,752,444 A | | 5/1998 | Lorig | |
| 5,802,975 A | * | 9/1998 | Prem et al. | 101/375 |
| 6,038,975 A | * | 3/2000 | Hoffman et al. | 101/375 |
| 6,289,809 B1 | * | 9/2001 | Sonobe | 101/401.1 |

FOREIGN PATENT DOCUMENTS

| | | |
|---|---|---|
| DE | 195 45 597 | 6/1997 |
| DE | 199 44 136 | 5/2000 |
| DE | 199 03 220 | 8/2000 |
| EP | 0 943 432 | 9/1999 |
| EP | 0 955 160 | 11/1999 |

* cited by examiner

*Primary Examiner*—Andrew H. Hirshfeld
*Assistant Examiner*—Marvin P. Crenshaw
(74) *Attorney, Agent, or Firm*—Fay, Sharpe, Fagan, Minnich & McKeem, LLP

(57) ABSTRACT

A sleeve (10) for flexographic printing includes a sleeve body (2) made of an at least partially non-electroconductive material, which within its inside (4) is mountable on an electroconductive king roll on the outer wall of the roll, of a printing press, the king roll being designed as an air cylinder, and exhibiting at least one contact zone with the king roll. The sleeve exhibits an electroconductive surface (6), which is connected to the contact zone via at least one electroconductive element (20) provided in the sleeve body (2) for diverting electrostatic charges into the outer wall of the roll of the king roll. The sleeve is therefore given an electroconductive structure, through which the unavoidable electrostatic charges in printing presses with a plurality of printing couples are diverted via the king roll before it reaches a scale that would suffice for a discharge, ignition, or deflagration of the solvents used in the printing.

22 Claims, 1 Drawing Sheet

SLEEVE FOR FLEXOGRAPHIC PRINTING

BACKGROUND OF INVENTION

The invention relates to a sleeve for flexographic printing, having a sleeve body made of an at least partially non-electroconductive material, which is mountable with its inside on an electroconductive king roll of a printing press designed as an air cylinder, and which in the assembly state exhibits at least one contact zone with the king roll.

When printing foils, paper sheets, paper pages, and other substrates, the use of so-called sleeves (working sleeves), which are mounted on king rolls of printing presses using an air cushion and which hold the printing block, made of rubber or other elastic synthetic photopolymer, for a subsequent printing process, has increasingly been gaining acceptance. The king rolls of the printing presses, which are almost without exception made of steel cylinders, are for this purpose provided with an internal air system leading to bore holes on the outer wall of the roll, which are impinged on with compressed air when the sleeves are axially pushed and pulled in order to slightly stretch the sleeve body of the sleeve. The sleeve bodies of the sleeves are in particular made of glass fiber reinforced plastics in order to be able to reversibly absorb these elongations. In sleeves for flexographic printing with wall thicknesses of more than 5 mm, at least one compressible flexible foam layer is additionally provided in order to ensure the stretching of the sleeve body during mounting or dismounting despite the considerable wall thickness. Sleeve variations are also known, in which the entire wall structure is made of a compressible material. After mounting, and with the compressed air switched off, the sleeve sits in a press-fit on the outer wall of the roll of the king roll and is rotationally fixed thereto.

In order to print on foils, paper sheets, or paper strips, solvent-containing colors are used, with a multi-roll system with ink duct and color ductor or other suitable inking apparatus indicated for printing being used in the flexographic printing press for each color. In modern flexographic printing presses, there is an increasing need for a great number of printing couples and, at the same time, for large-format king rolls or sleeves. Among experts, it was previously assumed that in flexographic printing, because of the small number of printing couples, the problem of electrostatic charging is negligible, and even in combustible solvents, such as alcohols, glycol or carboxylic acid ester used in flexographic printing, an ignition or deflagration of the solvents in the colors is not expected. A reason for this may have been the small number of printing couples previously existing in printing presses.

However, because of higher demands on work safety and the need for flexographic printing presses with a greater number of printing couples, the problem of electrostatic charging even in printing presses for flexographic printing can no longer be ignored. Electrostatic charging may occur in various areas of the printing press. For instance, they may occur between the substrate to be printed on, such as a foil, and the printing block, because of the lifting motion and because of excessive charging of the dye. If suitable protective measures are not met, as the number of printing couples increase, the electrostatic charges increase as the substrate to be printed on advances in the machine, so that dangerous discharges into the ink ducts or into the chamber color ductor may occur in the rear printing couples as seen from the direction of processing.

It is basically known to the expert that the scale of the charging depends on the surface finish and the conductibility of the substrate to be printed on, its speed of passage through the inking systems, the surface finish, the conductibility, as well as the modes of operation of the devices used in the inking system (e.g., color ductor, guiding elements, color chamber, etc.), as well as the ambience conditions in the printing press. Electrostatic charges may be limited by suitably adjusting to the ambience conditions, in particular keeping an atmospheric humidity of about 65% and/or air ionization in the working area.

SUMMARY OF THE INVENTION

The task of the present invention is to create a sleeve for flexographic printing that is made of an at least partially non-electroconductive material so that it may be mounted following the air-cushion principle, and at the same time, minimizes or avoids the problem of electrostatic charging.

This task is achieved with the present invention specified in the independent claims. Advantageous embodiments of the present invention are specified in the sub-claims. According to the present invention, the sleeves made of a (partially) non-conductive material are provided with an electroconductive structure through which the unavoidable electrostatic charges are directly diverted via the king roll, so that the charging of the individual sleeves or application rollers in the printing couple cannot reach a scale sufficient for a discharge, ignition, or deflagration of the solvents, and are also not passed on to subsequent printing couples. This is achieved in that the sleeve is provided with an electroconductive surface that is connected to the contact zone via at least one electroconductive element provided in the sleeve body for diverting electrostatic charges into the outer wall of the roll of the king roll. The electroconductive surface of the sleeve, and therefore, the sleeve for flexographic printing, is grounded via the element provided in the sleeve body and via the outer wall of the roll of the king roll. The sleeves according to the present invention are given an electroconductive structure that does not add to its weight. The modest weight desired by the user may also be achieved or preserved with the sleeves according to the present invention.

Within the scope of the revelation of the present invention, electroconductive substances or materials are, in particular, meant to be those whose specific resistance is less than $10^4$ Ωm. However, since what matters in the invention is the diversion of the electrostatic charge, substances or materials that are electrostatic dissipative and whose specific resistance is between $10^4$ Ωm and approximately $10^9$ Ωm may also fall under electroconductive substances or materials. Consequently, such substances and materials whose specific resistance is greater than $10^4$ Ωm or which are neither conductive nor have a dissipative ability are not conductive.

The electroconductive surface of the sleeve may be formed or applied in various ways. In an embodiment, the sleeve body may be provided on its outer surface with a conductive lacquer forming the surface of the sleeve. A varnish may be given the desired conductibility, for example, by mixing with conductive particles, such as soot, or with metal pigments, such as silver or copper or the like. Alternatively, the surface of the sleeve body may be made of a conductive synthetic layer, in particular a conductive polyurethane layer, which is already provided during the build-up of the sleeve or is applied only subsequently. The synthetic layer may, in particular, also be made of glass fiber reinforced plastics (GFRP) having a conductive matrix, or of a carbon fiber reinforced polymer (CFRP), which is conductive due to the carbon fibers. Alternatively, the sleeve body may be provided on its surface with a metallic coating forming the surface of the sleeve. The sleeve body may, for example, be vacuum-coated with a suitable metal. The application of the conductive lacquer as well as the application of a metallic coating makes it possible to retrofit already existing sleeves for flexographic printing and is supposed to subsequently make them conductive in a sleeve service.

The electrical conductivity of the sleeve may alternatively also be achieved by making the sleeve body out of a composite material with electroconductive inserts forming an interlacing of fasteners. In a preferred embodiment, the sleeve body may for this purpose be made of a metal fiber or carbon fiber reinforced polymer (CFRP), while ensuring during the manufacture of the sleeve that the inserts or fibers extend not just axially, but also radially from the contact surface up to the surface.

A sleeve completely made out of CFRP is mountable only in thin wall thicknesses of up to about 5 mm. For thicker wall thicknesses, the sleeve body is normally provided with at least one layer of non-conductive, compressible material in order to ensure the size of the sleeve for the mounting or dismounting. For such sleeves, it is provided according to the present invention for the layer made of non-conductive material to be penetrated by the element for diverting electrostatic charges. In the preferred embodiment of a sleeve with a non-conductive, cylindrical layer or interlayer, the element is provided in a radially extending recess in the sleeve body. The recess may be formed by a radial borehole, in particular. So that the diverting element for the electrostatic charging does not hinder the compressibility of the layer made of a non-conductive material, it is particularly favorable in this embodiment if the element may change its length in radial direction, and after the mounting, independently adjusts to the length necessary for the electrical connection. This may preferably be achieved by having the element exhibit a spring-loaded contact body. It is particularly advantageous if the contact body is arranged in such a way that it juts out beyond the inside of the sleeve body before the mounting. Using the spring, the contact body is therefore preloaded towards the inside of the sleeve, or pressed in the mounting state against the outer wall of the roll of the king roll, thereby ensuring the electroconductive connection between the conductive surface of the sleeve and the electroconductive king roll. In order to facilitate the assembly of the sleeve and prevent obstructions to the lifting motion at the element, it is advantageous if the contact body is formed by a ball or at least exhibits a spherical contact end.

In order to able to install the element in sleeves in a simple manner, it may exhibit an electroconductive housing, e.g., made of metal, which contains the spring and the contact body, and with its housing bottom, is connected to the conductive surface. As set forth at the start, already existing sleeves or sleeve bodies may subsequently be made conductive. For this purpose, a sleeve body made of non-conductive material, in particular, may subsequently be provided with at least one radial through-bore hole, into which an element is inserted for electrostatic diversion before the conductive surface is applied. The element may, in particular, be screwed or glued in place into the through-bore or the recess. It is furthermore favorable if the recess or through-bore is countersunk on the inside of the sleeve body so that the air cushion occurring between the inside of the sleeve body and the king roll during the mounting or dismounting of the sleeve may not result in a displacement or loosening of the element or its housing.

In order to ensure a uniform concentricity of the sleeve and/or to ensure a complete diversion of the occurring electrostatic charge in large-surface sleeves, several elements may be provided, in particular in a rotationally symmetrical manner, for diverting the electrostatic charge.

The contact zone need not inevitably lie on the inside of the sleeve. Most king rolls are provided with a centering overhang for the register adjustment, with the sleeve using the centering overhang to center itself with a centering recess during the mounting. In such king rolls, the contact zone may thus be a component of the centering recess, resulting in the further advantage that the compressibility of the interlayer is not affected. In order to ensure the contact of the contact zone with the centering overhang, spring-loaded contact elements may be provided in the centering recess.

Alternatively, the sleeve body, as an element for the electrostatic diversion, may exhibit at least one fiber made of a conductive material, in particular of metal.

BRIEF DESCRIPTION OF THE DRAWINGS

The present invention will now be explained using an embodiment, with reference to the drawings. Shown in the drawings are.

DETAILED DESCRIPTION OF PREFERRED EMBODIMENT

Figure 3:
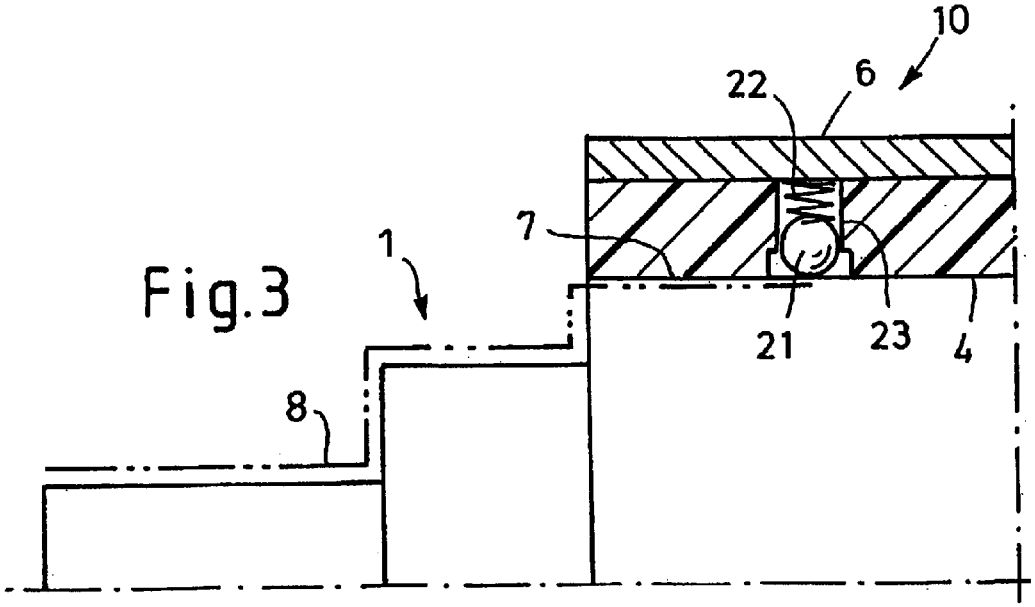
FIG. 3 is a schematic section of the sleeve from FIG. 1, mounted on a king roll of a flexographic printing press.

In the figures, reference number 10 indicates a sleeve for the flexographic printing, which is mountable on a flexographic printing press—not shown further—according to the air-cushion principle, on a king roll 1 designed as an air cylinder, shown exclusively in FIG. 3. Sleeve 10 has a cylindrical sleeve body 2 with a multi-layer structure. Sleeve 10 may, in particular, be a so-called build-up sleeve. Sleeve body 10 may exhibit a base sleeve made of a glass fiber reinforced plastic, for example, which is provided with several layers, such as compressible flexible foam, LD casting compound, high-resistance foam, and a hard coat or soft coat outer layer. The type and fastening of the printing blocks, used for printing and which is not shown, then depend on the outer layer selected.

In the embodiment shown, sleeve body 2 is made either completely out of a non-electroconductive material, or sleeve body 2 exhibits a continuous interlayer made of a non-electroconductive material, which produces an insulation between the outside 3 of sleeve body 2 and its inside 4. Layer 5 made of an electroconductive material is placed according to the present invention on the outside 3 of sleeve body 2. Layer 5 may be a vacuum-coated metal coating of a conductive lacquer, for example. Because of layer 5, sleeve 10 has an electroconductive surface 6 over the entire circumference and over its entire axial length.

In sleeve body 2, at least one element indicated with reference number 20 is provided for diverting electrostatic charges from surface 6 of sleeve 10 to its inside 4. Element 20 is provided in a radial bore hole 23 in sleeve body 2, which is open on the inside 4 of sleeve body 2 and is covered over towards the outside by electroconductive layer 5.

Figure 1:
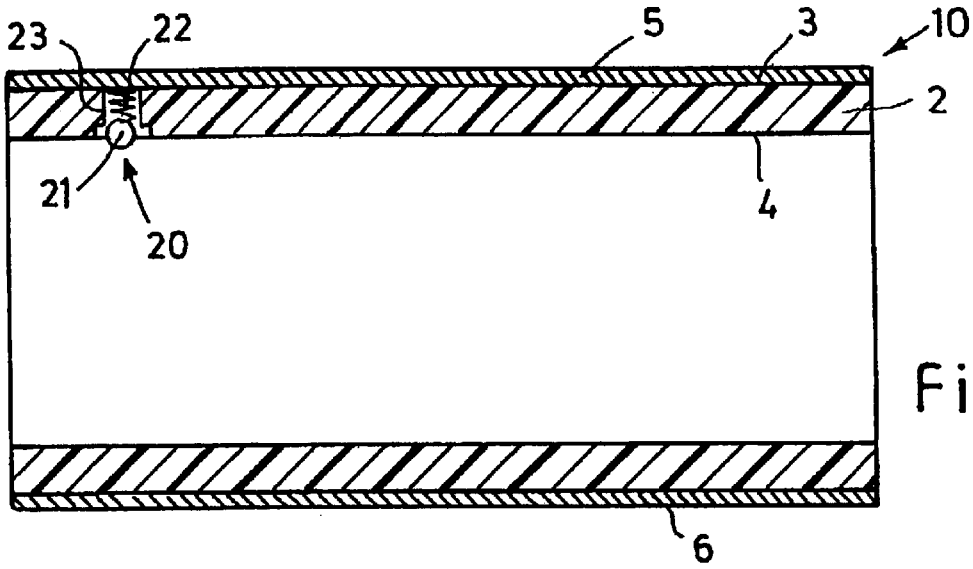
FIG. 1 is a longitudinal section through a sleeve, according to an embodiment in accordance with the present invention.
Figure 2:
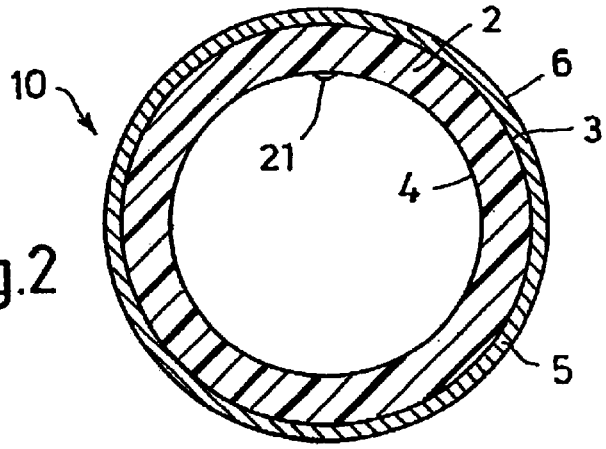
FIG. 2 is a schematic representation of a front view of the sleeve from FIG. 2.

Element 20 includes a contact body, shown here as ball 21, which is prestressed with spring 22 towards the inside 4 of the adapter sleeve. Ball 21 and spring 22, which are both electroconductive, are provided in an electroconductive housing, not shown further, which is put in radial bore hole 23. In the non-mounted state of sleeve 10, as shown in FIGS. 1 and 2, ball 21 juts out beyond the inside 4 of sleeve body 2 with a part of its surface. The housing and matching radial bore hole 23 are designed in such a way that ball 21 may be plunged completely into sleeve body 2 by introducing a force in a radial direction. This force in a radial direction inevitably occurs after mounting sleeve 10 on king roll 1, as FIG. 3 shows.

The closing band of the housing is preferably arranged in such a way that it does not reach up to the inside 4 of sleeve body 2. Furthermore, through-bore 23 should be provided with a countersink or a step to prevent element 20 from being loosened or displaced by the air cushion during mounting of the sleeve on king roll 1.

FIG. 3 shows sleeve 10 in a mounted state on king roll 1. Since the inside 4 of sleeve 10 and outer wall of the roll 7 of king roll 1 are cylindrical, a contact zone between sleeve 10 and king roll 1 arises over the full axial length. The air system of king roll 1 is not illustrated. As FIG. 3 well shows, ball 21 completely submerges into radial borehole 23, but is pressed against outer wall of the roll 7 of king roll 1 via spring 22. Electrostatic charges are passed on via surface 6 or layer 5, spring 22 and ball 23, to outer wall 7 of king roll 1, and from there, diverted from all printing couples via casing of king roll 1, symbolically illustrated by line 8 in FIG. 3.

The embodiment shown in the figures is only an example and is not supposed to limit the range of protection of the present invention applied for. The present invention may be realized in new sleeves. The element for diverting electrostatic charges may also be subsequently installed in already existing sleeves made of a non-conductive material. Also covered by the inventive idea, therefore, is a method with which sleeves may subsequently be made conductive by providing the outside with an electroconductive layer and installing an element in the sleeve body, which ensures the electroconductive connection between the inside of the sleeve and its surface. Finally, the present invention is also not limited to placing the sleeve directly on the air cylinder. Embodiments in which the sleeve is mountable under the interlayer of a so-called adapter sleeve on the air cylinder of a printing press should therefore also come into the scope of the attached claims. In the embodiment with adapter sleeve, the adapter sleeve is either electroconductive and the element is on the contact zone between the inside of the sleeve and the outside of the adapter sleeve, or the adapter sleeve is non-electroconductive and the element for diverting electrostatic chargings extends up to the outer wall of the roll of the king roll. Furthermore, an element that brings about the diversion of the electrostatic charging according to the present invention may also be provided in the adapter sleeve.

We claim:

1. A sleeve for flexographic printing, comprising a sleeve body (2) made of an at least partially non-electroconductive material, which within its inside (4) is mountable on an electroconductive king roll (1) of a printing press designed as an air cylinder, and exhibiting at least one contact zone with the king roll (1), said sleeve further comprising an electroconductive surface (6), which is connected to the contact zone via at least one electroconductive element (20) provided in the sleeve body (2) for diverting electrostatic chargings into the outer wall of the roll (7) of the king roll (1), wherein the electroconductive element (20) comprises a spring-loaded contact body and may change its length in radial direction.

2. The sleeve according to claim 1, wherein the sleeve body (2) comprises on its outer surface a conductive lacquer forming the electroconductive surface (6) of the sleeve (10).

3. The sleeve according to claim 1, wherein the sleeve body comprises on its outer surface a metallic coating forming the surface of the sleeve.

4. The sleeve according to claim 1, wherein the sleeve body comprises a composite material with electroconductive inserts forming the elements for diverting the electrostatic charging.

5. The sleeve according to claim 4, wherein the sleeve body comprises a carbon fiber reinforced polymer (CFRP).

6. The sleeve according to claim 1, wherein the sleeve body comprises at least one layer of non-conductive material, which is radially penetrated by the electroconductive element (20).

7. The sleeve according to claim 1, wherein the electroconductive element (20) is provided in a radially extending recess (23) in the sleeve body (2).

8. The sleeve according to claim 7, wherein the electroconductive element (20) is screwed or glued in place into the radially extending recess.

9. The sleeve according to claim 7, wherein the radially extending recess or radial bore hole is provided from the inside with a depression.

10. The sleeve according to claim 1, wherein the electroconductive element (20) comprises a contact body, which juts out beyond the inside (4) of the sleeve body (2) before the mounting.

11. The sleeve according to claim 10, wherein the contact body comprises a ball (21) or exhibits a hemispherical contact end.

12. The sleeve according to claim 1, wherein the sleeve body made of a non-conductive material is provided with at least one radial through-bore, into which the electroconductive element (20) is inserted for electrostatic diversion before the conductive surface is applied to the sleeve body.

13. The sleeve according to claim 1, comprising several electroconductive elements (20) arranged in a rotationally symmetrical manner for diverting the electrostatic charge.

14. The sleeve according to claim 1, wherein wherein the electroconductive surface comprises a conductive synthetic layer, in particular a conductive polyurethane layer.

15. The sleeve according to claim 1, wherein the sleeve body comprises at least one fiber made of a conductive material.

16. The sleeve according to claim 1, wherein the sleeve is an adapter sleeve, or the sleeve is mountable under the interlayer of an adapter sleeve on the king roll.

17. A sleeve for flexographic printing, comprising a sleeve body (2) made of an at least partially non-electroconductive material, which within its inside (4) is mountable on an electroconductive king roll (1) of a printing press designed as an air cylinder, and exhibiting at least one contact zone with the king roll (1), said sleeve further comprising an electroconductive surface (6), which is connected to the contact zone via at least one electroconductive element (20) provided in the sleeve body (2) for diverting electrostatic chargings into the outer wall of the roll (7) of the king roll (1), wherein the electroconductive surface comprises a conductive synthetic layer, in particular a conductive polyurethane layer.

18. The sleeve according to claim 17, wherein the synthetic layer comprises at least one of glass fiber reinforced plastic (GFRP) having a conductive matrix, or a carbon fiber reinforced polymer (CFRP).

19. The sleeve according to claim 17, wherein the electroconductive element (20) may change its length in radial direction.

20. The sleeve according to claim 19, wherein the electroconductive element (20) comprises a spring-loaded contact body.

21. A sleeve for flexographic printing, comprising a sleeve body (2) made of an at least partially non-electroconductive material, which within its inside (4) is mountable on an electroconductive king roll (1) of a printing press designed as an air cylinder, and exhibiting at least one contact zone with the king roll (1), said sleeve further comprising an electroconductive surface (6), which is connected to the contact zone via at least one electroconductive element (20) provided in the sleeve body (2) for diverting electrostatic chargings into the outer wall of the roll (7) of the king roll (1) wherein:

the sleeve body comprises at least one layer of non-conductive material, which is radially penetrated by the at least one electroconductive element (20); and, the at least one electroconductive element (20) comprises a housing that accommodates a spring and a contact body.

22. A sleeve for flexographic printing, said sleeve comprising:

a body comprising an at least partially non-electroconductive material and defining a space adapted to receive an associated king roll, said body further comprising an electroconductive surface and an electroconductive element for electrically interconnecting the electroconductive surface to an associated king roll located in said space, wherein the electroconductive element for electrically interconnecting the electroconductive surface to an associated king roll located in said space comprises a radially movable spring-biased contact body.

* * * * *